US005443051A

United States Patent [19]

Otsuka

[11] Patent Number: 5,443,051

[45] Date of Patent: Aug. 22, 1995

[54] APPARATUS FOR DETECTING A MALFUNCTION IN AN EVAPORATED FUEL PURGE SYSTEM

[75] Inventor: Takayuki Otsuka, Susono, Japan

[73] Assignee: Toyota Jidosha Kabushiki Kaisha, Toyota, Japan

[21] Appl. No.: 200,095

[22] Filed: Feb. 22, 1994

[30] Foreign Application Priority Data

Feb. 26, 1993 [JP] Japan ..... 5-038654

[51] Int. Cl.[6] ..... F02M 33/02

[52] U.S. Cl. ..... 123/520; 123/198 D

[58] Field of Search ..... 123/520, 519, 518, 516, 123/521, 198 D

[56] References Cited

U.S. PATENT DOCUMENTS

| | | | |
|---|---|---|---|
| 4,949,695 | 8/1990 | Uranishi | 123/198 D |
| 5,143,035 | 9/1992 | Kayanuma | 123/198 D |
| 5,172,672 | 12/1992 | Harada | 123/198 D |
| 5,245,973 | 9/1993 | Otsuka | 123/198 D |
| 5,263,461 | 11/1993 | Fujimoto | 123/198 D |
| 5,265,577 | 11/1993 | Denz | 123/198 D |
| 5,295,472 | 3/1994 | Otsuka | 123/198 D |
| 5,313,925 | 5/1994 | Otsuka | 123/198 D |
| 5,315,980 | 5/1994 | Otsuka | 123/198 D |
| 5,333,589 | 8/1994 | Otsuka | 123/520 |
| 5,363,828 | 11/1994 | Yamashita | 123/520 |
| 5,425,344 | 6/1995 | Otsuka | 123/520 |

FOREIGN PATENT DOCUMENTS

| | | |
|---|---|---|
| 2-130255 | 5/1990 | Japan . |
| 3-17169 | 2/1991 | Japan . |
| 3-26862 | 2/1991 | Japan . |
| 4-72453 | 3/1992 | Japan . |
| 4-503844 | 7/1992 | Japan . |

*Primary Examiner*—Carl S. Miller

*Attorney, Agent, or Firm*—Kenyon & Kenyon

[57] ABSTRACT

A malfunction detecting apparatus of an evaporated fuel purge system includes: a negative pressure control part for switching on a purge control valve to open a purge line between a canister and an intake passage of an engine during a process time, and for switching off the purge control valve at the end of the process time, so that the purge line and a vapor line are subjected to a negative pressure of the intake passage; a pressure detecting part arranged in a line connected to the purge line and to the vapor line for measuring a purge line pressure within the system and for outputting the measured pressure; and a discriminating part for detecting whether or not a malfunction in the system has occurred, based on the measured pressure supplied from the pressure detecting part, for calculating a continuous time during which the measured pressure is continuously lower than a reference pressure value within the process time, and for detecting whether or not the continuous time exceeds a reference time value within the process time.

12 Claims, 16 Drawing Sheets

DUTY RATIO
%
100
0
TIME

POSITIVE PRESSURE
ATMOSPHERIC PRESSURE
NEGATIVE PRESSURE
PURGE LINE PRESSURE
A
B
TIME
REFERENCE TIME
REFERENCE PRESSURE (NEGATIVE)

APPARATUS FOR DETECTING A MALFUNCTION IN AN EVAPORATED FUEL PURGE SYSTEM

BACKGROUND OF THE INVENTION (1) Field of the Invention

The present invention generally relates to a malfunction detecting apparatus of an evaporated fuel purge system, and more particularly to an apparatus for detecting a malfunction in an evaporated fuel purge system in which evaporated fuel from a fuel tank is absorbed in a canister and the evaporated fuel of the canister is supplied to an intake passage of an engine via a purge line when the engine is operating under a prescribed operating condition.

(2) Description of the Related Art

An internal combustion engine of an automotive vehicle is provided with an evaporated fuel purge system. In this evaporated fuel purge system, evaporated fuel supplied from a fuel tank is absorbed by an absorbent of a canister, and the evaporated fuel of the canister is supplied (or purged) to an intake passage of the engine when the engine is operating under a prescribed operating condition. The flow of the evaporated fuel from the canister to the intake passage is adjusted by means of the evaporated fuel purge system, so as to suitably control the flow of an air-fuel mixture from the intake passage to the combustion chamber of the engine. In order to prevent the evaporated fuel from escaping from the system to the atmosphere, the respective parts of the evaporated fuel purge system are hermetically closed.

Occasionally, the evaporated fuel purge system including the fuel tank and the canister may malfunction. For example, a vapor line between the fuel tank and the canister may be damaged, a piping line within the system may be separated, and a purge line between the canister and the intake passage may be clogged. If the vapor line is damaged or the piping line is separated, the evaporated fuel from the fuel tank will escape from the system to the atmosphere, and thus wasted. If the purge line is clogged, the evaporated fuel from the fuel tank will overflow the canister, and thus the evaporated fuel of the canister will leak to the atmosphere via the air inlet opening of the canister.

Therefore, it is necessary to accurately detect the occurrence of any malfunction in the evaporated fuel purge system in order to maintain the exhaust emission and the drivability at an appropriate level.

The inventor of the present invention has proposed several malfunction detecting apparatuses for the evaporated fuel purge system. For example, a proposed malfunction detecting apparatus employs a purge control valve arranged at an intermediate portion of the purge line between the canister and the intake passage, and this purge control valve is switched on and off so as to open and close the purge line. See Japanese Patent Application No. 4-23952. The invention disclosed in this application is assigned to the assignee of the present invention.

In the proposed apparatus mentioned above, the purge control valve is switched on to open the purge line so that an evaporated fuel line of the system is subjected to a negative pressure of the intake passage, and a start pressure of the evaporated fuel pressure line is measured. The purge control valve is switched off after a predetermined time to close the purge line, and an end pressure of the evaporated fuel line is measured. The malfunction discrimination is made based on a pressure change between the measured start pressure and the end pressure.

Another proposed malfunction detecting apparatus uses the purge control valve arranged in the purge line and an internal pressure control valve arranged in the vapor line between the fuel tank and the canister. In this apparatus, the purge control valve is switched on to subject the evaporated fuel line of the system to a negative pressure of the intake passage of the engine. The internal pressure control valve is switched on and off, and a pressure of a first portion between the internal pressure control valve and the fuel tank and a pressure of a second portion between the internal pressure control valve and the canister are measured by a pressure sensor. The malfunction discrimination for the first portion and the malfunction discrimination for the second portion are separately made based on the respective measured pressures. See Japanese Patent Application No. 4-258331. The invention disclosed by this prior application was assigned to the assignee of the present invention.

In the proposed apparatus disclosed in Japanese Patent Application No. 4-23952, a vacuum switching valve (VSV) is used as the purge control valve, and this valve is switched on and off by performing a duty ratio control process. In the evaporated fuel purge system, when a great amount of fuel vapor absorbed in the canister is supplied to the intake passage via the purge line, the air fuel mixture fed from the intake passage to the engine is considerably affected by the amount of the purged fuel vapor supplied from the canister to the intake passage. The exhaust emission performance and the drivability are likely to be deteriorated due to the change of the air fuel mixture on such an occasion. In order to prevent this, it is necessary to suitably adjust the flow rate of the purged fuel vapor from the canister to the intake passage in accordance with the flow rate of the intake air of the engine.

In the proposed apparatus mentioned above, a duty ratio control process for the purge control valve (VSV) is performed in order to suitably adjust the flow rate of the purged fuel vapor. To minimize the deterioration of the exhaust emission, the purge control valve (VSV) is switched on and off by a duty ratio control signal indicating a small duty ratio, which signal is determined by the duty ratio control process.

However, in the evaporated fuel purge system, a fluctuation of the purge line pressure occurs when the duty ratio control process for the VSV is performed in the manner described above. This pressure fluctuation is relatively large when the purge line between the canister and the intake passage is not completely opened by the VSV, and the maximum level of the pressure fluctuation is reached when the duty ratio of the VSV is around 50%.

The duty ratio control process for the purge control valve (VSV) is performed to make the duty ratio of an on-time of the VSV within a duty cycle to a total duty-cycle time as small as possible, as indicated in FIG. 1A, so that the purge line of the evaporated fuel purge system is subjected to a negative pressure of the intake passage for a shorter time. The malfunction discrimination of the system is made based on the measured pressure of the purge line when the duty ratio control process is performed. If the measured pressure is higher than a reference pressure indicated in FIG. 1B, it is determined that a malfunction in the system has occurred. If the measured pressure is lower than the reference pressure, it is determined that the system is normally operating, that is, that no malfunction has occurred.

However, the conventional evaporated fuel purge system has a problem in that the purge line pressure during a malfunction detecting process may fluctuate considerably, as indicated by a zigzag line B in FIG. 1B. The measured pressure output from the pressure sensor is detected as being instantaneously lower than the reference pressure, although the purge line pressure is higher than the reference pressure mostly as indicated by a curve line A in FIG. 1B. Therefore, in the case of the example shown in FIG. 1B, it may be erroneously determined that no malfunction in the system has occurred, even though the evaporated fuel purge system is actually malfunctioning, or the evaporated fuel is leaking in any part of the system.

SUMMARY OF THE INVENTION

Accordingly, it is a general object of the present invention to provide an improved malfunction detecting apparatus of an evaporated fuel purge system in which the above described problems are eliminated.

Another, more specific object of the present invention is to provide an apparatus for detecting a malfunction in an evaporated fuel purge system, which apparatus carries out a malfunction detecting process in which the erroneous discrimination due to the fluctuation of the purge line pressure during the process is prevented so as to realize an accurate and reliable malfunction discrimination.

The above mentioned objects of the present invention are achieved by a malfunction detecting apparatus which includes: a negative pressure control part for switching on a purge control valve to open a purge line between a canister and an intake passage of an engine during a process time, and for switching off the purge control valve at the end of the process time, so that the purge line and a vapor line are subjected to a negative pressure of the intake passage; a pressure detecting part, arranged in a pressure line connected to the purge line and to the vapor line, for measuring a purge line pressure in an evaporated fuel purge system, and for outputting the measured purge line pressure; and a discriminating part for detecting whether or not a malfunction in the system has occurred, based on the measured purge line pressure supplied from the pressure detecting part, for calculating a continuous time during which the measured pressure is continuously lower than a reference pressure value within the process time, and for detecting whether or not the continuous time exceeds a reference time value within the process time.

The above mentioned objects of the present invention are also achieved by a malfunction detecting apparatus which includes: a negative pressure control part for switching on the purge control valve to open the purge line between the canister and the intake passage during a malfunction detecting process time, and for switching off the purge control valve at the end of the process time, so that the purge line and the vapor line are subjected to a negative pressure of the intake passage; a pressure detecting part, arranged in a pressure line connected to the purge line and to the vapor line, for measuring a purge line pressure within the system, and for outputting the measured pressure; and a discriminating part for calculating a weighted average of the measured pressures supplied from the pressure detecting part, and for detecting whether or not a malfunction in the system has occurred, based on a value of the weighted average at the end of the process time.

The above mentioned objects of the present invention are also achieved by a malfunction detecting apparatus which includes: a negative pressure control part for switching on the purge control valve to open the purge line between the canister and the intake passage during a malfunction detecting process time, and for switching off the purge control valve at the end of the process time, so that the purge line and the vapor line are subjected to a negative pressure of the intake passage; a pressure detecting part, arranged in a pressure line connected to the purge line and to the vapor line, for measuring a purge line pressure within the system, and for outputting the measured pressure; a capacity part, arranged in the pressure line between the pressure detecting part and the purge line, for preventing a fluctuation of the purge line pressure during the malfunction detecting process; and a discriminating part for detecting whether or not a malfunction in the system has occurred, based on the measured pressure supplied from the pressure detecting part, and for detecting whether or not the measured pressure at the end of the process time is lower than a reference pressure value.

According to the present invention, it is possible to suitably prevent the erroneous discrimination of the malfunction detecting apparatus due to the purge line pressure fluctuation. The malfunction detecting apparatus according to the present invention can accurately and reliably detect the occurrence of a malfunction in the evaporated fuel purge system.

BRIEF DESCRIPTION OF THE DRAWINGS

The above and other objects, features and advantages of the present invention will be more apparent from the following detailed description when read in conjunction with the accompanying drawings in which.

DESCRIPTION OF THE PREFERRED EMBODIMENTS

A description will now be given, with reference to FIGS. 2 through 4, of the malfunction detecting apparatus according to the present invention.

Figures 1A, 1B:
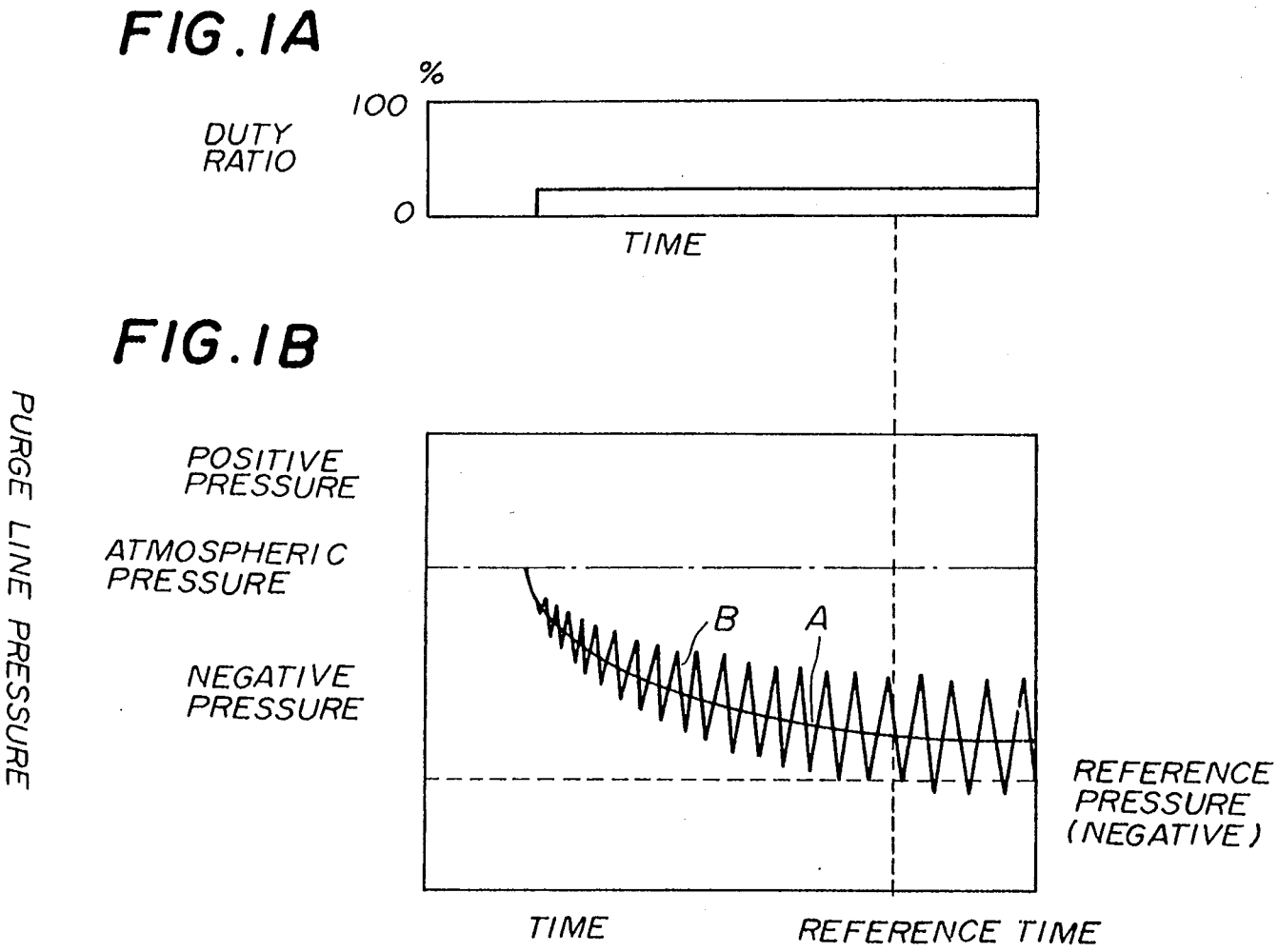
FIGS. 1A and 1B are time charts showing the operation of a conventional malfunction detecting apparatus.
Figure 2:
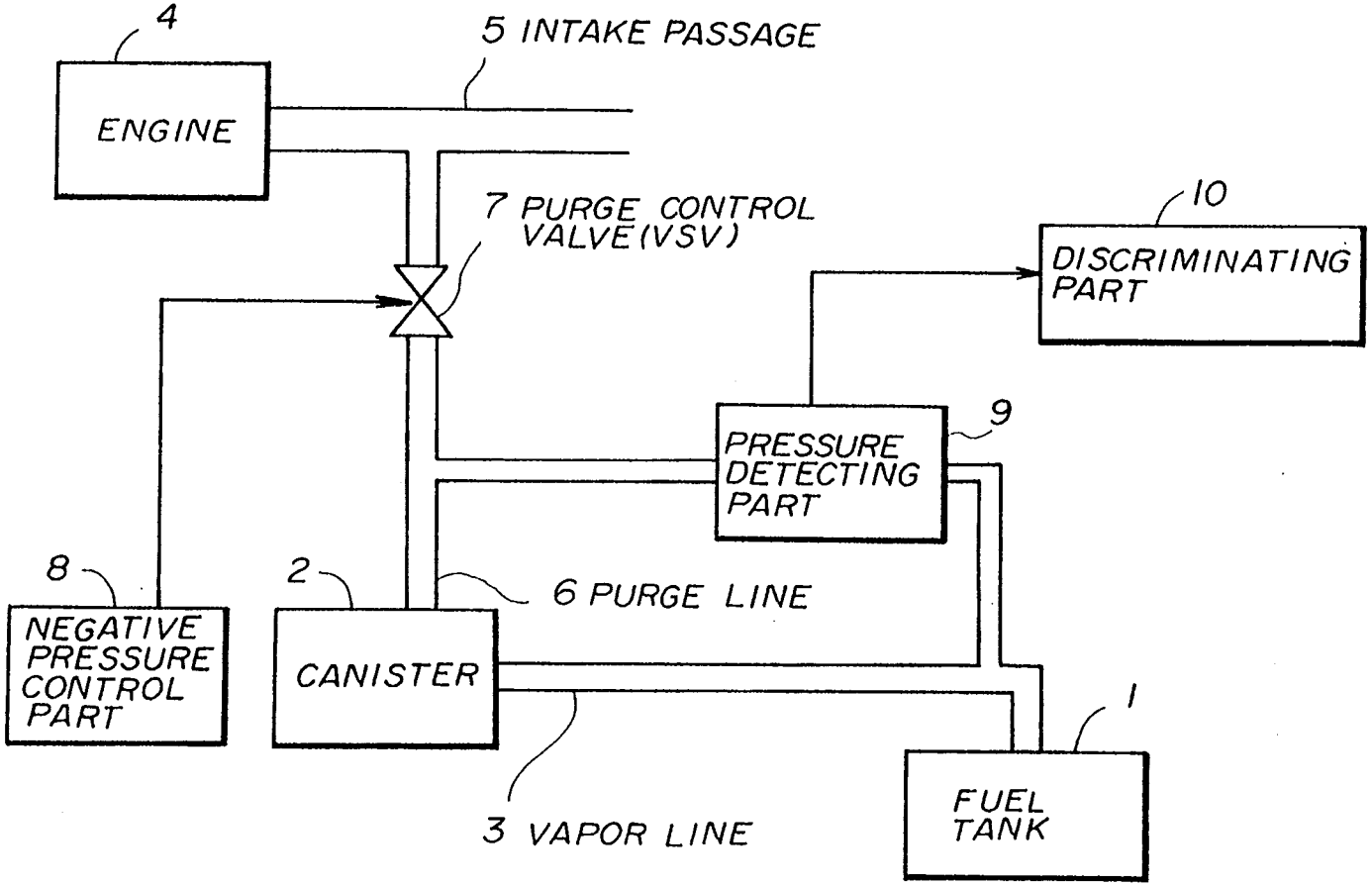
FIGS. 2 through 4 are block diagrams showing first through third embodiments of the malfunction detecting apparatus according to the present invention.

A malfunction detecting apparatus shown in FIG. 2 carries out a malfunction discrimination for an evaporated fuel purge system of an internal combustion engine. The evaporated fuel purge system includes a fuel tank 1, a canister 2, a vapor line 3 through which evaporated fuel from the fuel tank 1 is supplied to the canister 2, a purge line 6 through which the evaporated fuel of the canister 2 is supplied to an intake passage 5 of an engine 4, and a purge control valve (VSV) 7 arranged at an intermediate portion of the purge line 6 for controlling the flow of the evaporated fuel from the canister 2 to the intake passage 5.

The malfunction detecting apparatus in FIG. 2 comprises a negative pressure control part 8, a pressure detecting part 9, and a discriminating part 10. The negative pressure control part 8 switches on the purge control valve 7 to open the purge line 6 between the canister 2 and the intake passage 5 during a malfunction detecting process time, and switches off the purge control valve 7 at the end of the process time, so that the purge line 6 and the vapor line 3 of the system are subjected to a negative pressure of the intake passage 5 during the malfunction detecting process. The pressure detecting part 9, which is arranged in a bypass line connected to the purge line 6 and to the vapor line 3, measures a purge line pressure within the system and supplies the measured pressure to the discriminating part 10. The discriminating part 10 detects whether or not a malfunction in the evaporated fuel purge system has occurred, based on the measured pressure from the pressure detecting part 9. The discriminating part 10 calculates a continuous time (B) during which the measured pressure is continuously lower than a reference pressure value (−Y) within a process time (X), and detects whether or not the continuous time (B) exceeds a reference time value (Z) within the process time (X). If the continuous time (B) is greater than or equal to the reference time value (Z), it is determined that a malfunction in the evaporated fuel purge system has occurred. If the continuous time (B) is smaller than the reference time value (Z), it is determined that the evaporated fuel purge system is normally operating.

In the apparatus in FIG. 2, the malfunction discrimination is made based on the continuous time during which the measured purge line pressure is continuously lower than the reference pressure value within the process time, and thus the erroneous discrimination due to the purge line pressure fluctuation can be prevented. Thus, it is possible to accurately and reliably detect the occurrence of any malfunction in the evaporated fuel purge system.

Figure 3:
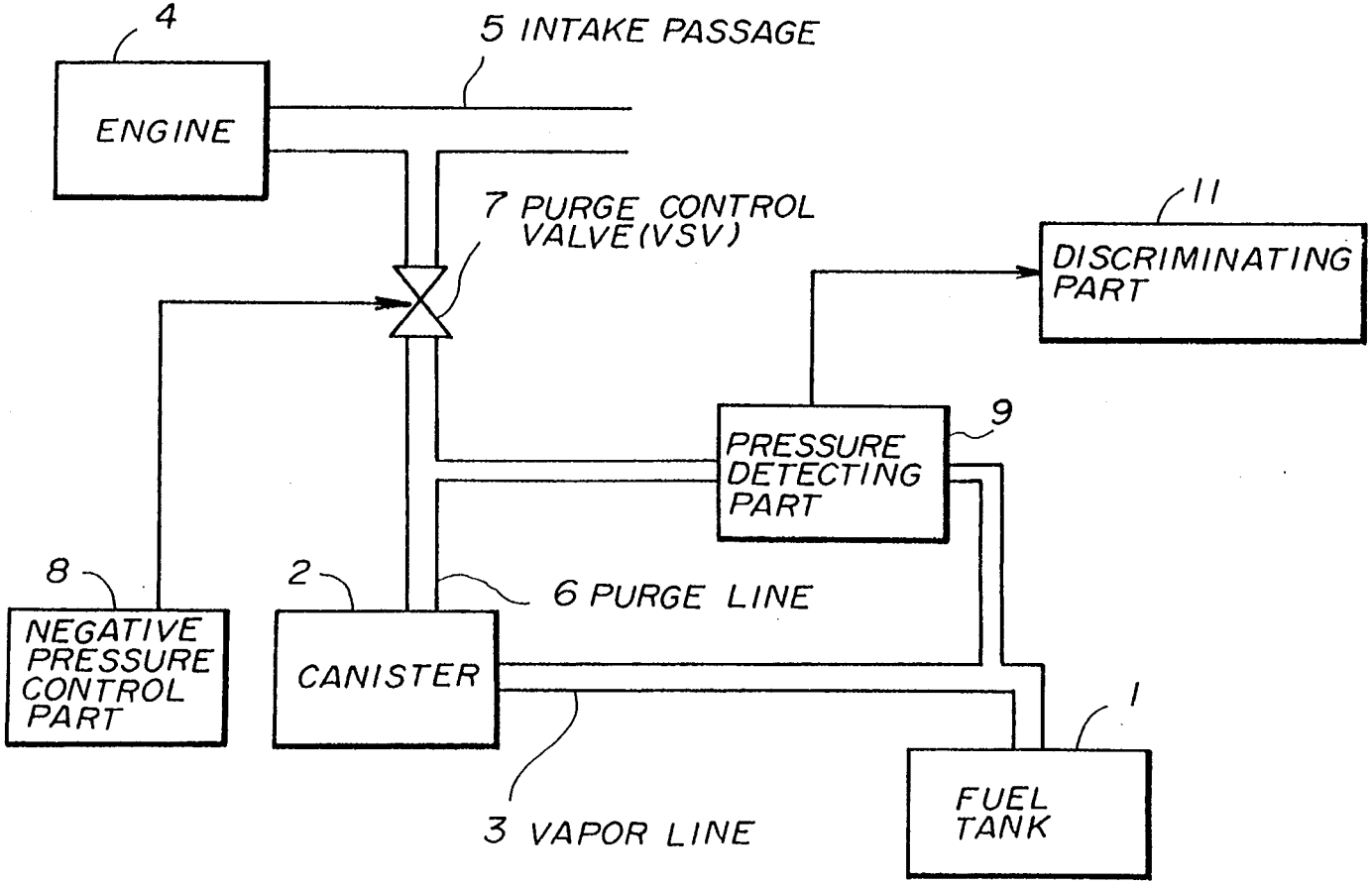

A malfunction detecting apparatus shown in FIG. 3 includes a discriminating part 11 instead of the discriminating part 10 in FIG. 2. In FIG. 3, the other parts are the same as corresponding parts of the apparatus in FIG. 2 and they are designated by the same reference numerals. The discriminating part 11 calculates a weighted average of the measured purge line pressures from the pressure detecting part 9, and detects whether or not a malfunction in the evaporated fuel purge system has occurred based on the value of the weighted average of the pressures. Thus the erroneous discrimination due to the purge line pressure fluctuation can be prevented, and it is therefore possible to accurately and reliably detect the occurrence of any malfunction in the evaporated fuel purge system.

Figure 4:
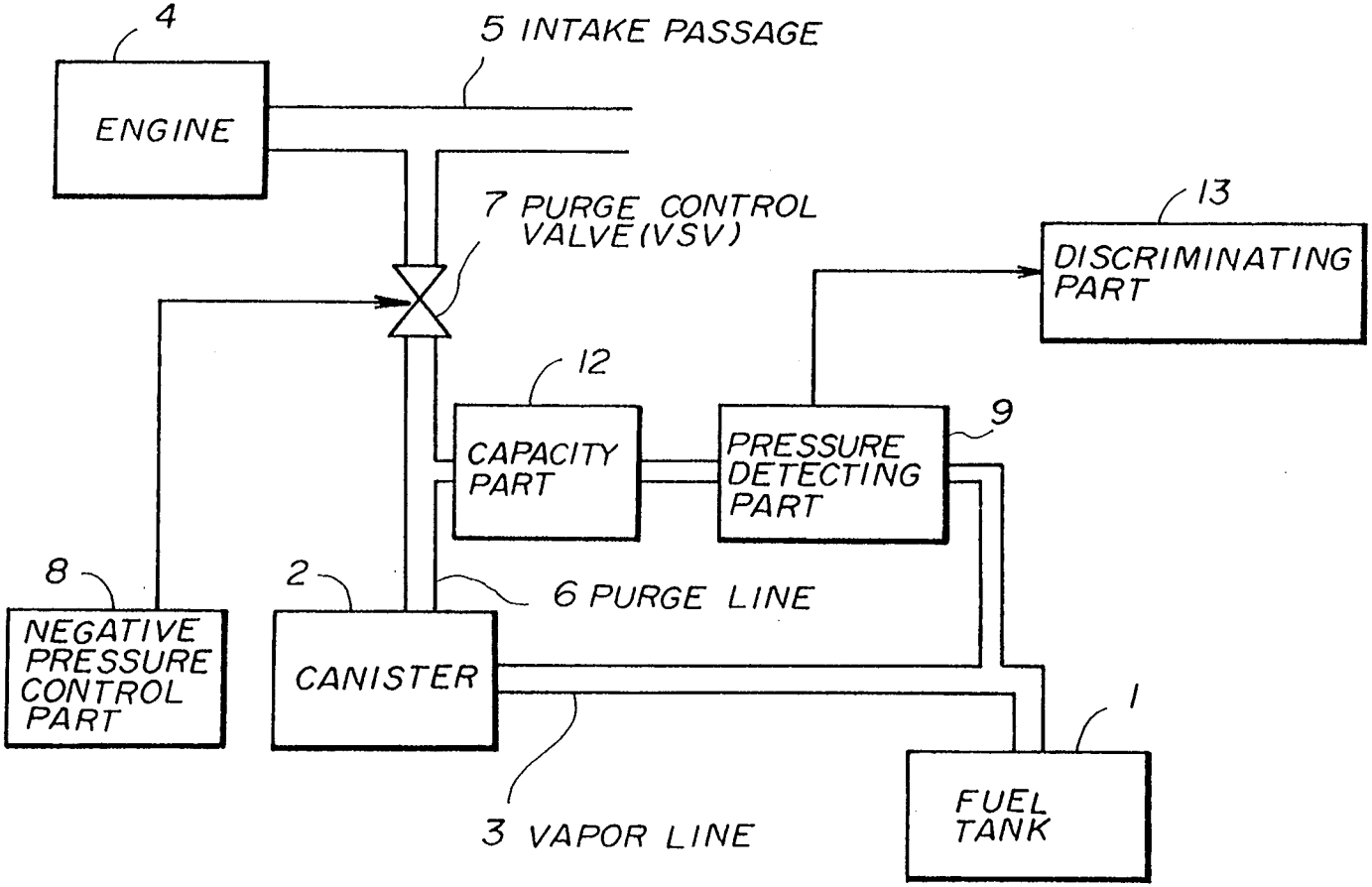

A malfunction detecting apparatus shown in FIG. 4 includes a capacity part 12 arranged in a purge line between the pressure detecting part 9 and the purge line 6. The apparatus in FIG. 4 includes a discriminating part 13 instead of the discriminating part 10 in FIG. 2. In FIG. 4, the other parts are the same as corresponding parts of the apparatus in FIG. 2 and they are designated by the same reference numerals. The fluctuation of the purge line pressure during a malfunction detecting process is prevented or absorbed by the capacity part 12, and the purge line pressure at this time is measured by the pressure detecting part 9. The discriminating part 13 performs the malfunction discrimination based on the measured pressure output from the pressure detecting part 9. Thus, the erroneous discrimination due to the purge line pressure fluctuation can be prevented, and it is possible to accurately and reliably detect the occurrence of any malfunction in the evaporated fuel purge system.

Next, a description will be given, with reference to FIGS. 5 through 9C, of the first embodiment of the malfunction detecting apparatus according to the present invention. The first embodiment corresponds to the malfunction detecting apparatus shown in FIG. 2.

Figure 5:
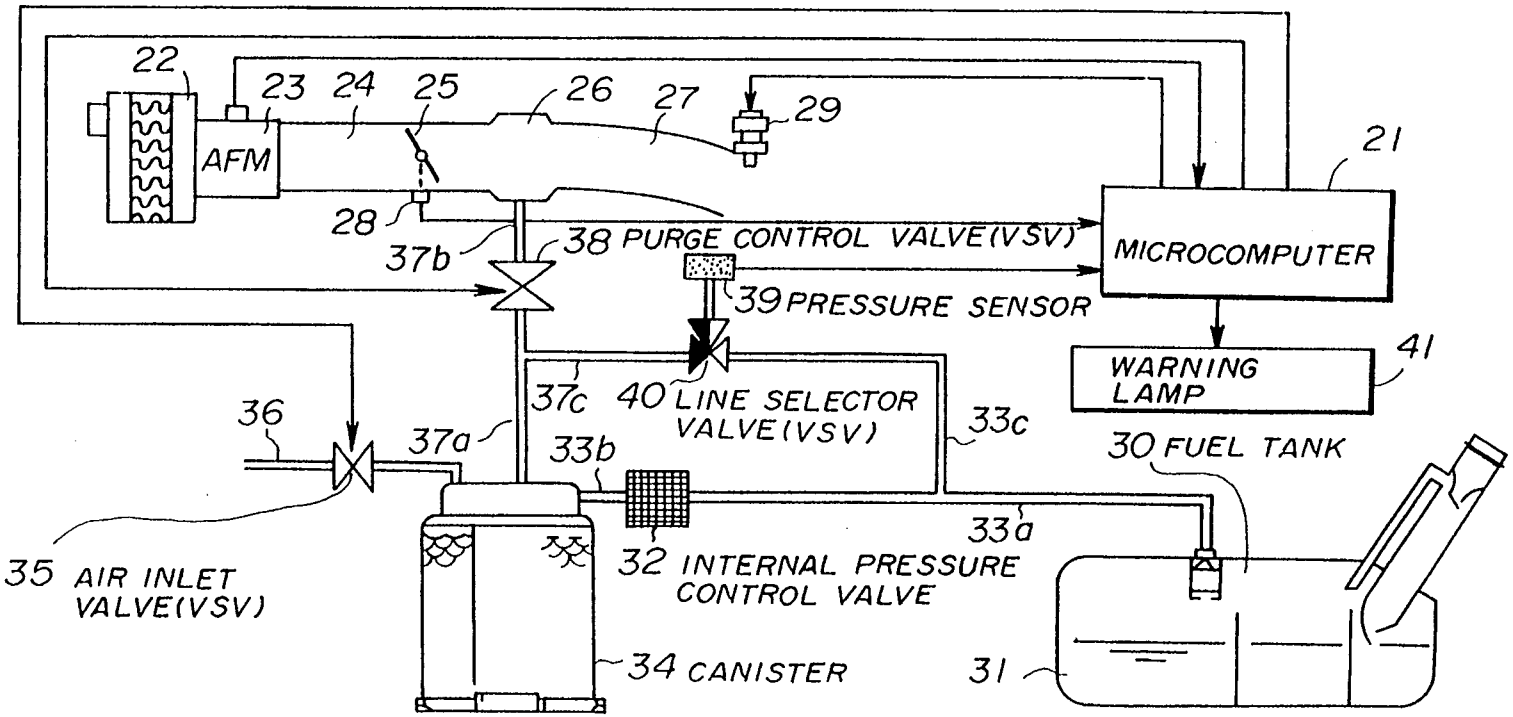
FIG. 5 is a diagram showing an evaporated fuel purge system to which the present invention is applied.

FIG. 5 shows an evaporated fuel purge system to which the first embodiment of the invention is applied. In FIG. 5, an intake passage of an internal combustion engine is shown, and this intake passage includes an air cleaner 22, an air flow meter (AFM) 23, an intake pipe 24, a surge tank 26, and an intake manifold 27 of the engine. The air cleaner 22 is arranged at the end of the intake passage to remove dust and the other matter from the external air. The air flow meter (AFM) 23 measures a rate of the flow of intake air passing through the intake passage, and a signal indicating the measured air flow rate is supplied from the AFM 23 to a microcomputer 21. The intake air passes through the surge tank 26 and the intake manifold 27, and is supplied to the combustion chamber (not shown) of the engine for a time period during which the intake valve (not shown) of the engine is opened.

A throttle valve 25 is arranged at an intermediate portion of the intake passage of the engine, and a position of the throttle valve 25 is adjusted in accordance with a position of an accelerator pedal (not shown) set by a vehicle operator, so as to control the flow of intake air passing through the intake passage. The position of the throttle valve 25 is sensed by a throttle position sensor 28, and a signal indicating the measured throttle position is supplied from the throttle position sensor 28 to the microcomputer 21.

A fuel injection valve 29 for each of cylinders of the engine is arranged in the intake manifold 27, this valve projecting into the inside of the intake manifold 27. The fuel injection valve 29 injects fuel, supplied from a fuel tank 30, to the intake air passing through the intake manifold 27 for a fuel injection time determined under the control of the microcomputer 21.

In FIG. 5, the fuel tank 30 contains fuel 31, and evaporated fuel (or fuel vapor) produced within the fuel tank 30 passes through a vapor line 33*a*, an internal pressure control valve 32 and a vapor line 33*b*, so that the evaporated fuel is supplied to a canister 34. The canister 34 contains an absorbent such as active carbon, and the fuel vapor from the fuel tank 30 is absorbed by the absorbent of the canister 34. An air inlet line 36 which is open at one end to the atmosphere is connected at the other end to the internal space of the canister 34. An air inlet valve (VSV) 35 is arranged at an intermediate portion of the air inlet line 36. Thus, the internal space of the canister 34 communicates with the atmosphere via the air inlet valve (VSV) 35. The air inlet valve 35 is switched on and off in accordance with a control signal supplied from the microcomputer 21, so as to open and close the air inlet line 36 between the canister 34 and the atmosphere.

The fuel vapor from the canister 34 passes through a purge line 37*a*, a purge control valve 38 and a purge line 37*b*, so that the fuel vapor is supplied to the intake passage of the engine. The canister 34 and the purge control valve 38 are connected to each other by the purge line 37*a*, and the purge control valve 38 and the surge tank 26 are connected to each other by the purge line 37*b*. The purge control valve 38 is switched on and off in accordance with a duty ratio control signal supplied from the microcomputer 21, so as to open and close the purge line between the canister 34 and the intake passage.

In the evaporated fuel purge system in FIG. 5, a three-way line selector valve (VSV) 40 is connected to the purge line 37*a* via a purge line 37*c*, and it is connected to the vapor line 33*a* via a vapor line 33*c*. A pressure sensor 39 for sensing a pressure within the evaporated fuel purge system is connected to this line selector valve 40, and a signal indicating the measured pressure is supplied from the pressure sensor 39 to the microcomputer 21. In the example shown in FIG. 5, the vapor lines 33*a* through 33*c* correspond to the vapor line 3, and the purge lines 37*a* through 37*c* correspond to the purge line 6.

The line selector valve (VSV) 40 is switched to either a first position or a second position in accordance with a control signal supplied from the microcomputer 21, so as to select one of the purge line 37*c* and the vapor line 33*c*. When the line selector valve 40 is switched to the first position, the pressure sensor 39 communicates with the purge line 37*c* via the valve 40 and senses a purge line pressure of the system. When the line selector valve 40 is switched to the second position, the pressure sensor 39 communicates with the vapor line 33*c* via the valve 40 and senses a vapor line pressure of the system. Therefore, by controlling the switching action of the line selector valve 40, it is possible that the vapor line pressure and the purge line pressure are separately sensed by means of the pressure sensor 39.

In FIG. 5, a warning lamp 41 is connected to the microcomputer 21. The warning lamp 41 is turned ON by a control signal output from the microcomputer 21 when it is determined that a malfunction in the evaporated fuel purge system has occurred, so as to notify the vehicle operator of the occurrence of the malfunction in the evaporated fuel purge system.

In the evaporated fuel purge system in FIG. 5, as mentioned above, the evaporated fuel from the fuel tank 30 is supplied to the canister 34 via the vapor line 33*a*, the internal pressure control valve 32, and the vapor line 33*b*, and the evaporated fuel is absorbed by the absorbent of the canister 34 so as to prevent the evaporated fuel from escaping to the atmosphere outside the system.

When the evaporated fuel purge system is normally operating, the air inlet valve (VSV) 35 is switched on to open the air inlet line 36 between the canister 34 and the atmosphere, and the purge control valve (VSV) 38 is switched on to open the purge line between the canister 34 and the intake passage. As the external air enters the canister 34 via the air inlet line 36 due to a negative pressure of the intake passage of the engine during operation, the internal space of the canister 34 communicates with the atmosphere. At this time, the evaporated fuel is desorbed from the absorbent of the canister 34, and the evaporated fuel is supplied to the surge tank 26 via the purge line 37*a*, the purge control valve 38 and the purge line 37*b* due to the negative pressure of the intake passage of the engine. The absorbent of the canister 34 is made active again by the desorption of the evaporated fuel, and it is thus ready for the subsequent absorption of other evaporated fuel.

Figure 6:
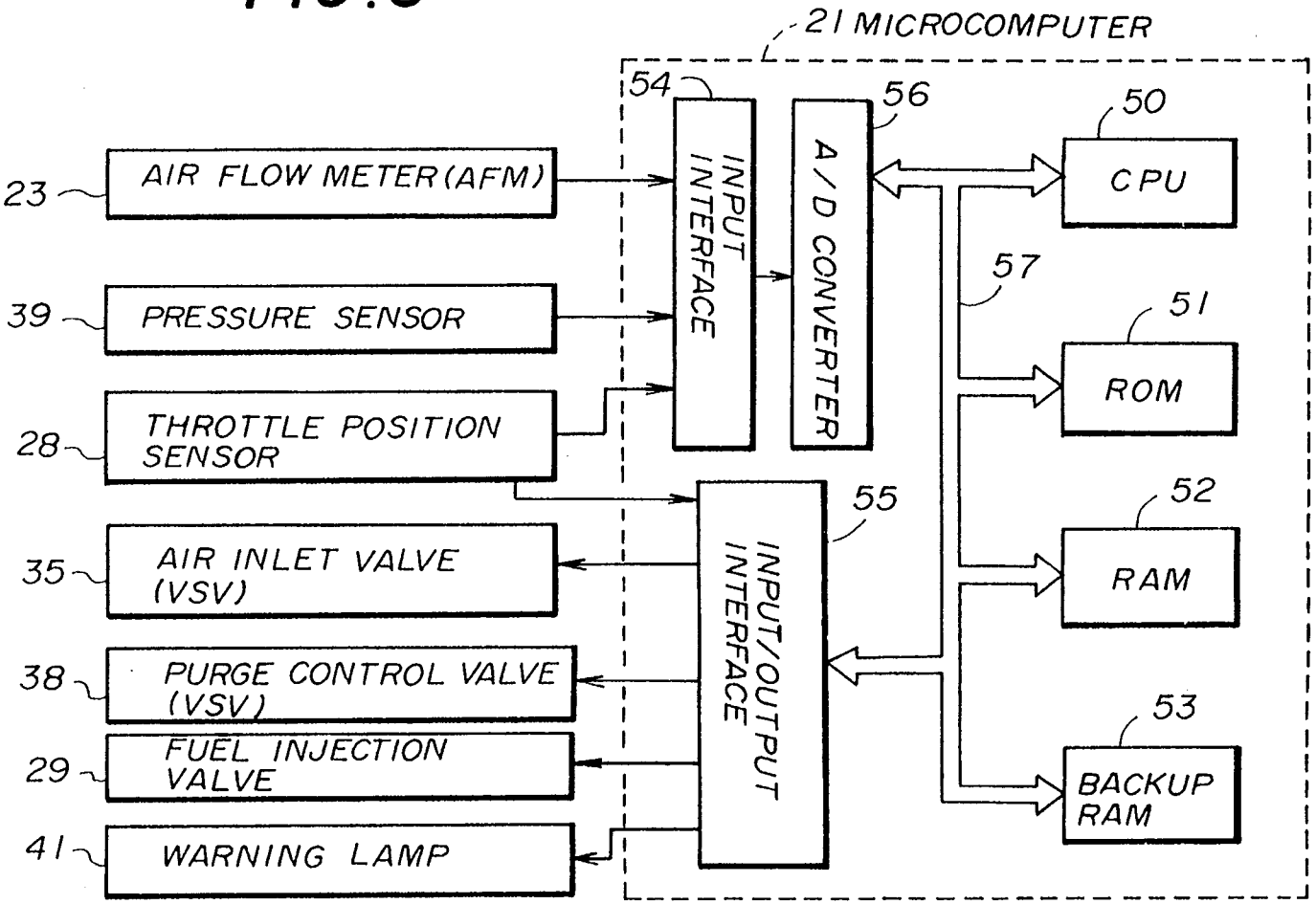
FIG. 6 is a block diagram showing a microcomputer of the evaporated fuel purge system in FIG. 5.

FIG. 6 shows the microcomputer of the evaporated fuel purge system in FIG. 5. The microcomputer 21 is a control unit which realizes the functions of the negative pressure control part 8 and the discriminating part 10 in the malfunction detecting apparatus of the present invention through software processing. The construction of the hardware of the microcomputer 21 shown in FIG. 6 is known. In FIG. 6, the parts which are the same as corresponding parts in FIG. 5 are designated by the same reference numerals, and a description thereof will be omitted.

The microcomputer in FIG. 6 has a central processing unit (CPU) 50, a read only memory (ROM) 51, a random access memory (RAM) 52, a backup RAM 53, an input interface circuit 54, an input/output interface circuit 55, and an analog-to-digital (A/D) converter 56. These components of the microcomputer 21 are interconnected by a bus 57. A processing program for achieving the functions of the malfunction detecting apparatus by means of the microcomputer 21 is stored in the ROM 51. The RAM 52 is used as a work area. The backup RAM 53 is a memory for continuously retaining necessary data even after the operation of the engine is stopped. The input interface circuit 54 is provided with a multiplexer.

The detection signal output from the air flow meter 23, the detection signal output from the pressure sensor 39 and the detection signal output from the throttle position sensor 28 are input to the input interface circuit 54. These detection signals are sequentially selected and an analog signal in which the detection signals are arranged in series is supplied from the input interface circuit 54 to the A/D converter 56. The analog signal from the input interface circuit 54 is converted into a digital signal by the A/D converter 56. This digital signal is supplied from the A/D converter 56 to the bus 57.

The detection signal output from the throttle position sensor 28 is input to the input/output interface circuit 55, and this signal is supplied from the input/output interface circuit 55 to the CPU 50 via the bus 57. On the other hand, control signals supplied from the bus 57 are selectively supplied from the input/output interface circuit 55 to the air inlet valve (VSV) 35, the purge control valve (VSV) 38, the fuel injection valve 29, and the warning lamp 41. The CPU 50 carries out a malfunction detecting process, in cooperation with the other components of the microcomputer 21, in accordance with the processing program stored in the ROM 51, so as to achieve the functions of the malfunction detecting apparatus of the present invention.

Figure 7:
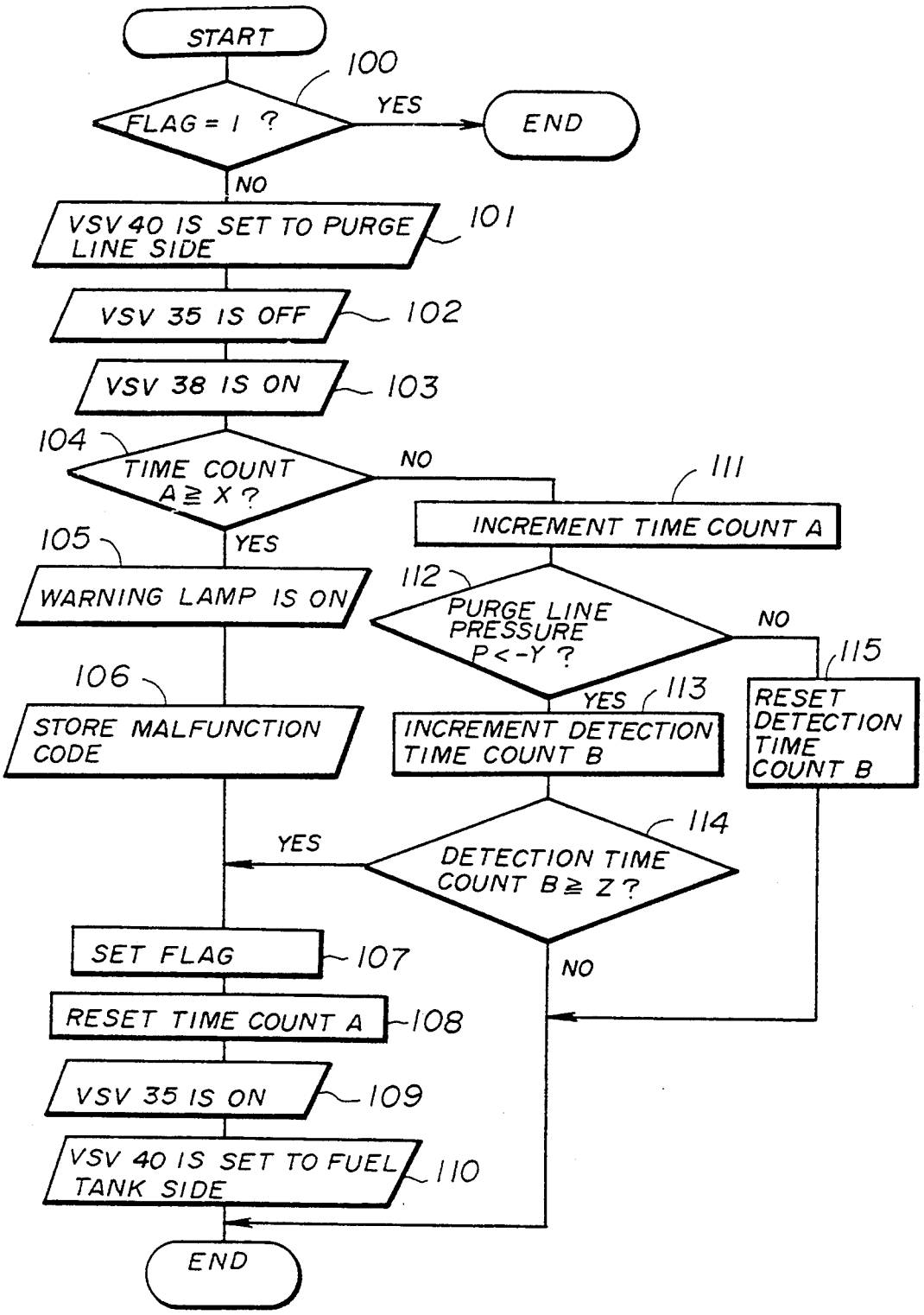
FIG. 7 is a flow chart for explaining a malfunction detecting process performed by the first embodiment of the present invention.

FIG. 7 shows a malfunction detecting process performed by the malfunction detecting apparatus of the first embodiment. This malfunction detecting process is repeatedly run by an interrupt at time intervals of, for example, 65 milliseconds (ms).

When the malfunction detecting process in FIG. 7 is started, the CPU 50 at step 100 detects whether or not an execution flag is equal to 1. If the result at step 100 is affirmative (the execution flag=1), the malfunction detecting process in FIG. 7 is finished. If the result at step 100 is negative (the execution flag=0), step 101 is performed. This execution flag is reset to zero at the time of the initialization.

Step 101 sets the line selector valve (VSV) 40 to the first position (the purge line side) so that the pressure sensor 39 is connected to the purge line 37*c* via the VSV 40. The line selector valve 40 is, at the time of the initialization, set to the second position (the fuel tank side) so as to connect the pressure sensor 39 to the vapor line 33*c* via the VSV 40. After step 101 is performed, step 102 switches OFF the air inlet valve (VSV) 35 so as to close the air inlet line 36 between the canister 34 and the atmosphere, and step 103 switches ON the purge control valve (VSV) 38 by a duty ratio control signal, so as to open the purge lines 37*a* and 37*b* between the canister 34 and the intake passage. The purge lines 37*a* through 37*c* at this time are subjected to a negative pressure of the intake passage. The VSV 38 is switched ON and the duty ratio of an on-time of the VSV 38 within a duty cycle to a total duty-cycle time is rather smaller than 100%. The duty ratio of the VSV 38 at this time is set to a value that is smaller than 50% (at which the fluctuation of the purge line pressure may be the maximum).

After step 103 is performed, step 104 detects whether or not a time count A is equal to or greater than a given process time (which is equal to, for example, X ms). The time count A is, at the time of the initialization, reset to zero. If the result at step 104 is negative ($A<X$), step 111 increments the time count A. After step 111 is performed, step 112 detects whether or not a measured purge line pressure P output from the pressure sensor 39 is lower than a given reference pressure value. This reference pressure value is equal to, for example, $-Y$ mmHg.

If the result at step 112 is negative ($P \geqq -Y$), step 115 resets a detection time count B to zero, and the malfunction detecting process in FIG. 7 is finished. If the result at step 112 is affirmative ($P<-Y$), step 113 increments the detection time count B, and step 114 is performed. The detection time count B is, at the time of the initialization, reset to zero. The detection time count B indicates the continuous time during which the measured pressure output from the pressure sensor 39 is continuously lower than the reference pressure value.

After step 113 is performed, step 114 detects whether or not the detection time count B exceeds a given reference time value (which is equal to, for example, Z ms). If the result at step 114 is negative ($B<Z$), the malfunction detecting process in FIG. 7 is finished. If the result at step 114 is affirmative ($B \geqq Z$), it is determined that the evaporated fuel purge system is normally operating, that is, that no malfunction has occurred, and steps 107 through 110 are performed. Step 107 sets the execution flag to 1, step 108 resets the time count A to zero, step 109 switches ON the air inlet valve (VSV) 35 to open the air inlet line 36 to the atmosphere, and step 110 sets the line selector valve (VSV) 40 to the second position (the fuel tank side) so as to connect the pressure sensor 39 to the vapor line 33*c* via the VSV 40. Then, the malfunction detecting process in FIG. 7 is finished.

On the other hand, if the result at step 104 is affirmative ($A \geqq X$), it is determined that a malfunction in the evaporated fuel purge system has occurred, as the continuous time (B) has not reached the reference time value (Z) within the process time (X) or the measured purge line pressure (P) is higher than the reference pressure value ($-Y$). Step 105 switches ON the warning lamp 41 to notify the vehicle operator of the occurrence of the malfunction. Step 106 stores a malfunction code (indicating a leak of the evaporated fuel purge system) in the backup RAM 53. After step 106 is performed, the steps 107–110 described above are performed, and the malfunction detecting process in FIG. 7 is finished.

The functions of the negative pressure control part 8 of the apparatus in FIG. 2 are achieved by performing the above described steps 100–104 by means of the microcomputer 21, and the functions of the discriminating part 10 in FIG. 2 are achieved by performing the above described steps 111–114 by means of the microcomputer 21.

Figure 8A:
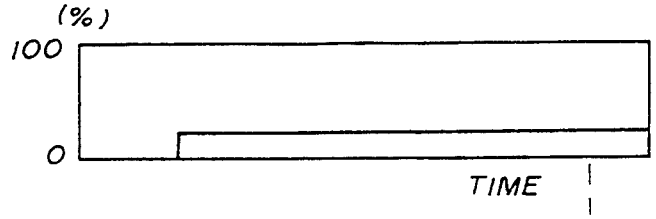
FIGS. 8A through 8C are time charts for explaining the operation of the malfunction detecting apparatus of the first embodiment.
Figure 8B:
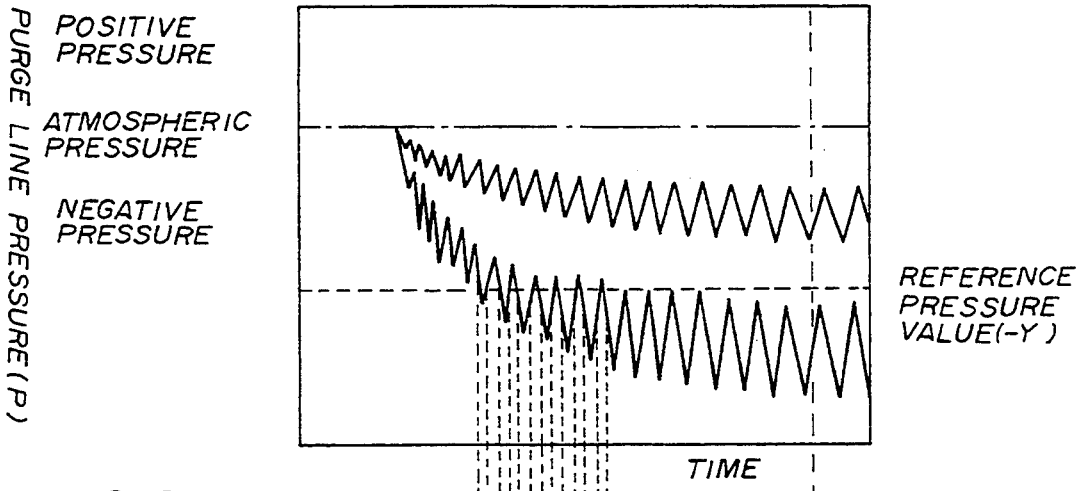
Figure 8C:
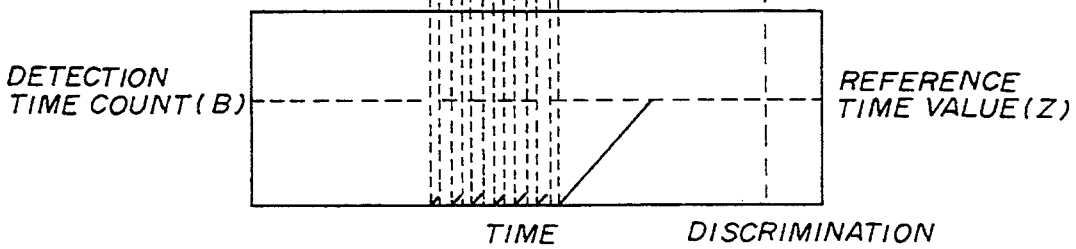

FIGS. 8A through 8C show the operation of the malfunction detecting apparatus of the first embodiment. In the apparatus in FIG. 5, the purge control valve (VSV) 38 is switched ON by a duty ratio control signal so as to make the canister 34 open to the intake passage via the purge lines, and this control signal indicates a relatively small duty ratio shown in FIG. 8A. The purge lines 37*a*–37*c* of the system are subjected to a negative pressure of the intake passage. At this time, the fluctuation of the purge line pressure shown, for example, in FIG. 8B may occur in the evaporated fuel purge system.

However, in the malfunction detecting apparatus in FIG. 5, the malfunction discrimination is made based on whether the continuous time (the detection time count B) during which the measured pressure (P) output from the pressure detecting part is continuously lower than the reference pressure value ($-Y$) within the process time exceeds the reference time valve (Z) or not, as indicated in FIG. 8C. Thus, the erroneous discrimination due to the fluctuation of the purge line pressure during the malfunction detecting process can be prevented so as to realize an accurate and reliable malfunction discrimination. Further, as the malfunction detecting process in which the VSV 38 is switched ON by a control signal with a relatively small duty ratio is carried out, it is possible to prevent the exhaust emission performance of the engine from being excessively deteriorated by the negative pressure control of the purge line of the system.

Figure 9A:
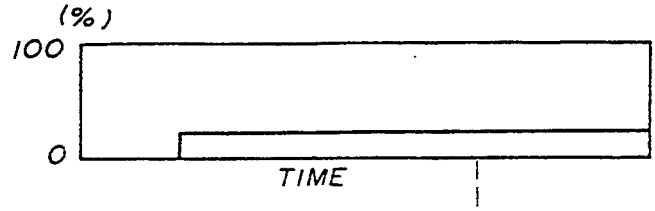
FIGS. 9A through 9C are time charts for explaining another operation of the malfunction detecting apparatus.
Figure 9B:
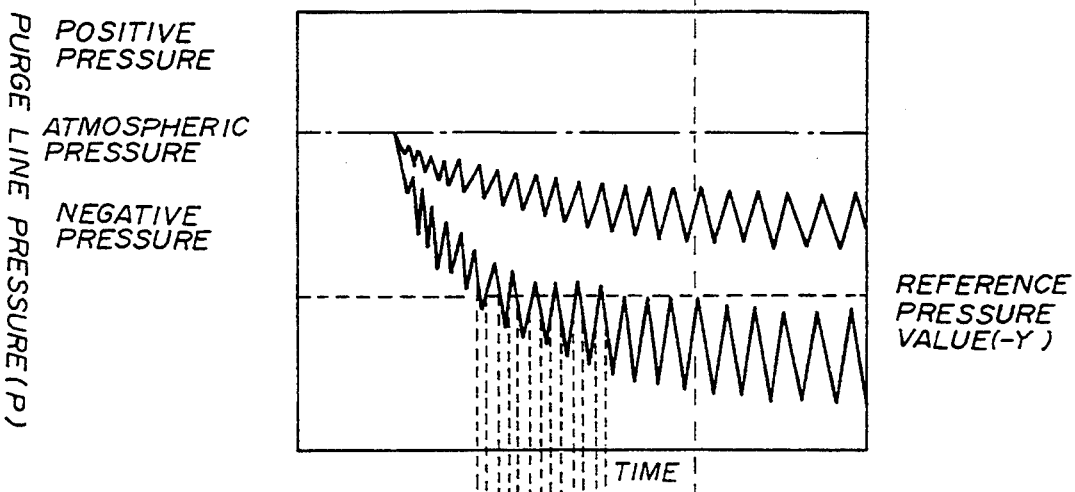
Figure 9C:
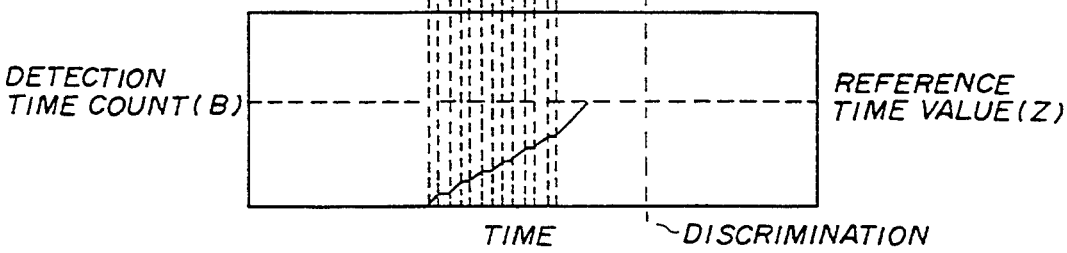

FIGS. 9A through 9C show another operation of the malfunction detecting apparatus of the first embodiment in which the discriminating part is modified. The discriminating part 10 of the first embodiment described above may be modified in such a manner that an accumulative time, during which the measured pressure (P)

output from the pressure detecting part 9 is lower than the reference pressure value (−Y) within the process time X, is calculated, whether the thus calculated accumulative time exceeds the reference time value (Z) or not being detected as indicated in FIG. 9C. Thus, in the example shown in FIGS. 9A–9C, the erroneous discrimination due to the fluctuation of the purge line pressure during the process can be prevented so as to enable an accurate and reliable malfunction discrimination. In order to realize the modified discriminating part mentioned above, only the step 115 at which the detection time count B is reset to zero is omitted from the malfunction detecting process in FIG. 7.

In addition, in the first embodiment described above, a check valve can be used instead of the air inlet valve (VSV) 35. It is also possible to modify the evaporated fuel purge system in FIG. 5 such that the internal pressure control valve (VSV) 32 is not arranged in the vapor lines between the fuel tank 30 and the canister 34. In such a modified system, the purge lines 37*a*–37*c* and the vapor lines 33*a*–33*c* of the system are subjected to a negative pressure of the intake passage when the purge control valve (VSV) 38 is switched ON and OFF. Alternatively, it is possible to modify the evaporated fuel purge system in FIG. 5 such that a bypass line passing around the internal pressure control valve (VSV) 32 is connected to the vapor lines 33*a* and 33*b*.

Next, a description will be given, with reference to FIGS. 10 through 12C, of the second embodiment of the present invention. The evaporated fuel purge system to which the second embodiment of the present invention is applied is essentially the same as that of the first embodiment shown in FIG. 5, except that the discriminating part (or the processing program in the microcomputer 21) differs from that of the first embodiment.

Figure 10:
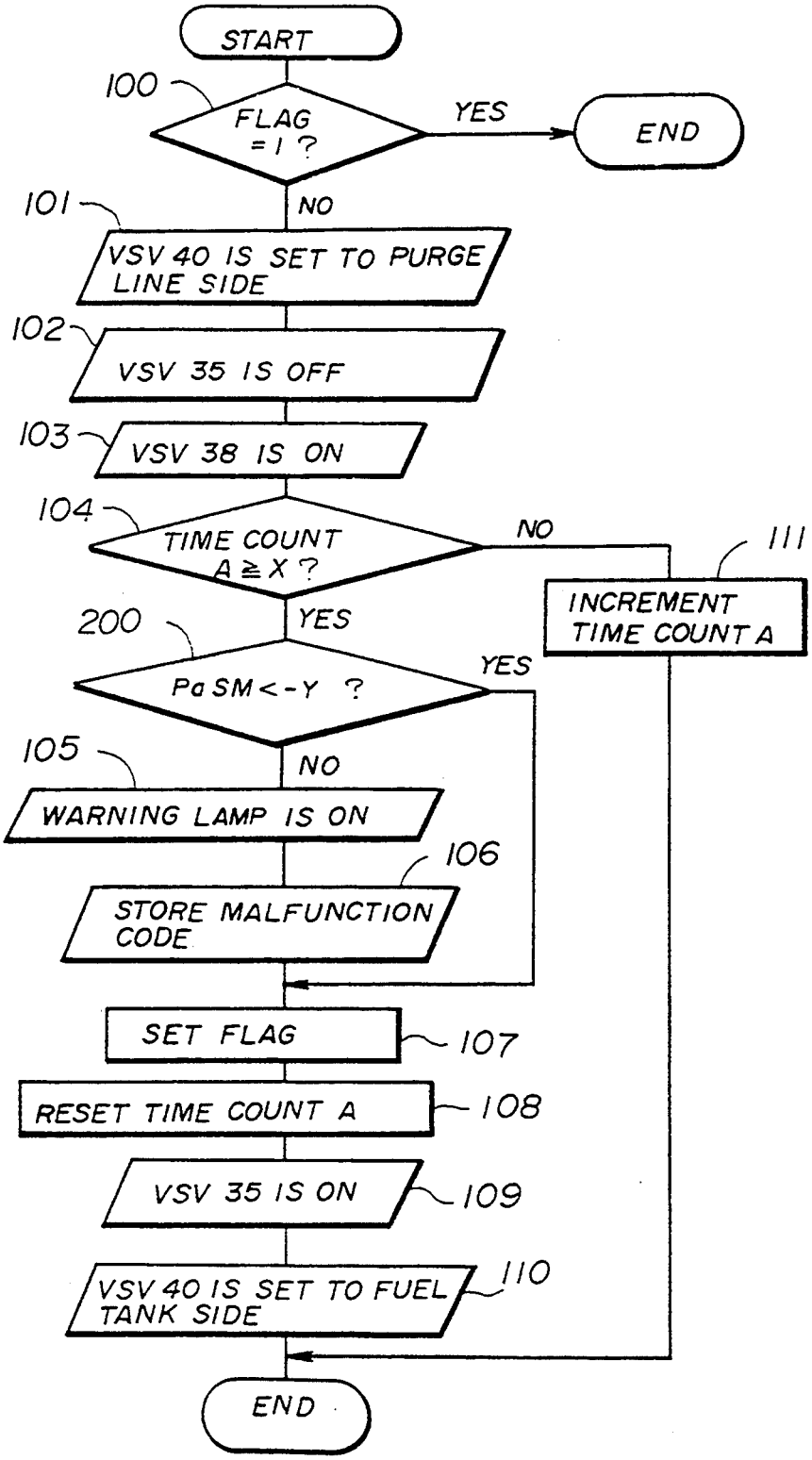
FIG. 10 is a flow chart for explaining a malfunction detecting process performed by the second embodiment of the present invention.

FIG. 10 shows a malfunction detecting process performed by the second embodiment of the present invention. In FIG. 10, the steps which are the same as corresponding steps of the first embodiment in FIG. 7 are designated by the same reference numerals, and a description thereof will be omitted. Similarly to the first embodiment, the functions of the negative pressure control part 8 and the discriminating part 11 in the second embodiment are achieved by using the processing program in the microcomputer 21. The malfunction detecting process in FIG. 10 is repeatedly run by an interrupt at time intervals of, for example, 65 ms.

In the malfunction detecting process in FIG. 10, if the result at the step 104 is affirmative (A≧X), step 200 which will be described below is performed, and, after the step 111 is performed, the steps 112–114 in FIG. 7 are not performed in the process in FIG. 10.

The CPU 50 of the microcomputer 21 at step 200 calculates a weighted average (PaSM) of the measured purge line pressures output from the pressure sensor 39 within the process time (X), and detects whether or not the weighted average (PaSM) of the measured pressures is lower than the reference pressure value (−Y).

If the result at step 200 is affirmative (PaSM < −Y), it is determined that the evaporated fuel purge system is normally operating, that is, that no malfunction has occurred. The steps 107–110, which are the same as corresponding steps of the first embodiment in FIG. 7, are then performed, and the malfunction detecting process in FIG. 10 is finished. On the other hand, if the result at step 200 is negative (PaSM≧−Y), it is determined that a malfunction in the evaporated fuel purge system has occurred. The steps 105–110, which are the same as corresponding steps of the first embodiment in FIG. 7, are then performed, and the malfunction detecting process in FIG. 10 is finished.

Figure 11:
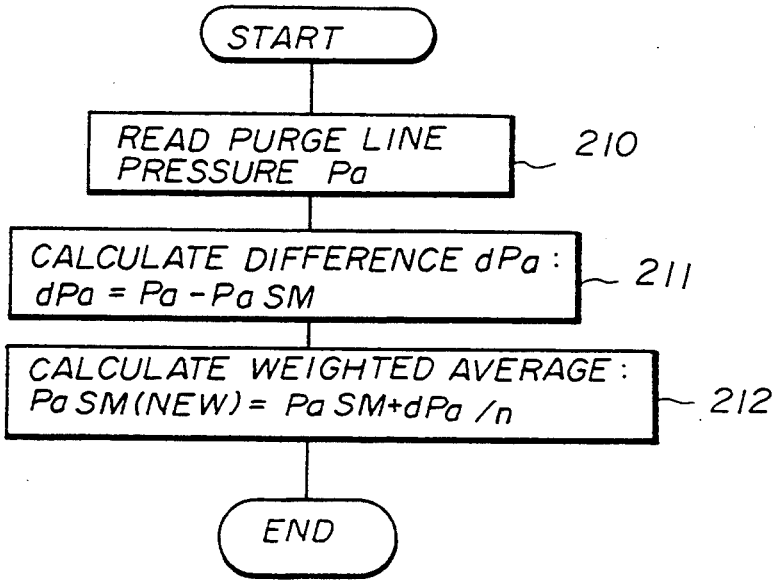
FIG. 11 is a flow chart for explaining a weighted average calculating process in connection with the malfunction detecting process in FIG. 10.

FIG. 11 shows a weighted average calculating process in connection with the malfunction detecting process in FIG. 10. This calculating process is repeatedly run, within the process time of the process in FIG. 10, in synchronism with the conversion of the purge line pressure of the pressure sensor 39 by the A/D converter 56.

When the weighted average calculating process in FIG. 11 is started, the CPU 50 of the microcomputer 21 at step 210 reads a purge line pressure Pa from the RAM 52. This purge line pressure is previously output from the pressure sensor 39 and stored in the RAM 52, and then it is read out from the RAM 52. Step 211 calculates the difference dPa between the purge line pressure Pa and a weighted average PaSM of the previous purge line pressures (dPa=Pa−PaSM).

After step 211 is performed, step 212 calculates a new weighted average PaSM by adding the difference dPa divided by a given coefficient n to the weighted average PaSM of the previous purge line pressures (PaSM-(NEW)=PaSM+dPa/n). After the calculation at step 212 is performed, the weighted average calculating process in FIG. 11 is finished.

The functions of the negative pressure control part 8 of the second embodiment in FIG. 3 are achieved by performing the steps 100–104 by means of the microcomputer 21, and the functions of the discriminating part 11 in FIG. 3 are achieved by performing the steps 200 and 210–212 by means of the microcomputer 21.

Figure 12A:
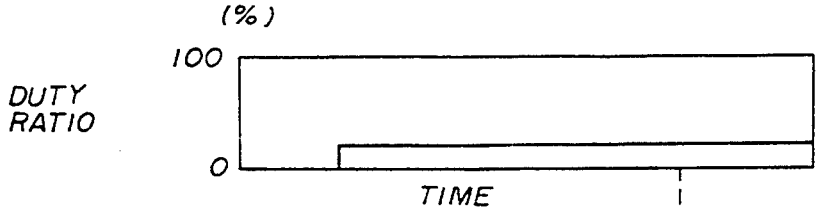
FIGS. 12A through 12C are time charts for explaining the operation of the malfunction detecting apparatus of the second embodiment.
Figure 12B:
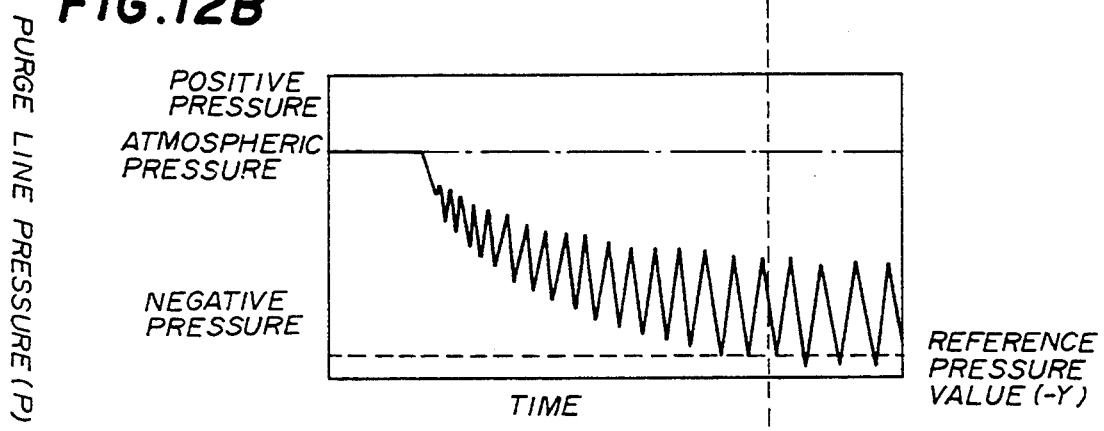
Figure 12C:
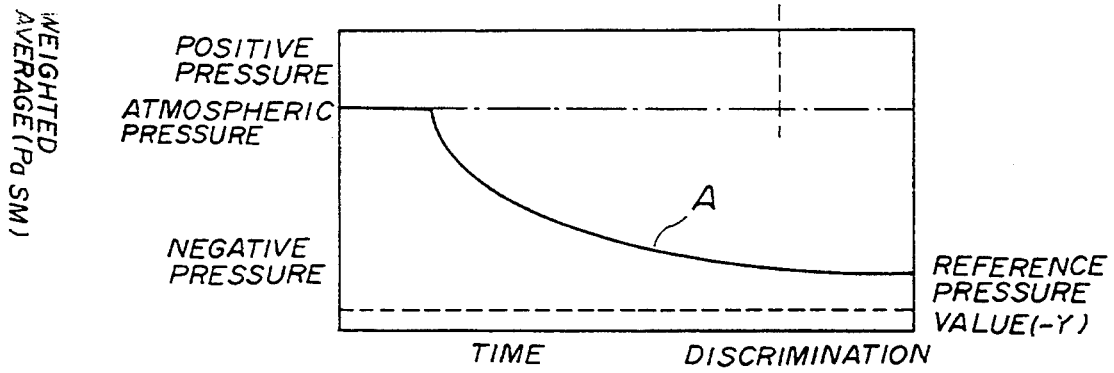

FIGS. 12A through 12C show the operation of the malfunction detecting apparatus of the second embodiment. In the evaporated fuel purge system in FIG. 5, the purge control valve (VSV) 38 is switched ON by a duty ratio control signal so as to have the canister 34 communicate with the intake passage via the purge lines, and this control signal indicates a relatively small duty ratio shown in FIG. 12A. The purge lines 37*a*–37*c* of the system are then subjected to a negative pressure of the intake passage of the engine. At this time, the fluctuation of the purge line pressure shown, for example, in FIG. 12B may occur.

However, in the malfunction detecting apparatus of the second embodiment, the malfunction discrimination is made based on the value of the weighted average of the purge line pressures output from the pressure sensor 39 within the process time. A curve A in FIG. 12C indicates the change of the weighted average during the malfunction detecting process. The malfunction discrimination of the second embodiment is made based whether the value of the weighted average (the curve) at the end of the process time is lower than the reference pressure value or not. Thus, similarly to the first embodiment, the erroneous discrimination due to the fluctuation of the purge line pressure during the process can be prevented, so as to realize an accurate and reliable malfunction discrimination. Further, as the malfunction detecting process in which the VSV 38 is switched ON by a control signal with a relatively small duty ratio is carried out, it is possible to prevent the exhaust emission performance of the engine from being deteriorated by the negative pressure control of the purge line of the system.

Next, a description will be given, with reference to FIGS. 13 through 16, of the third embodiment of the present invention.

Figure 13:
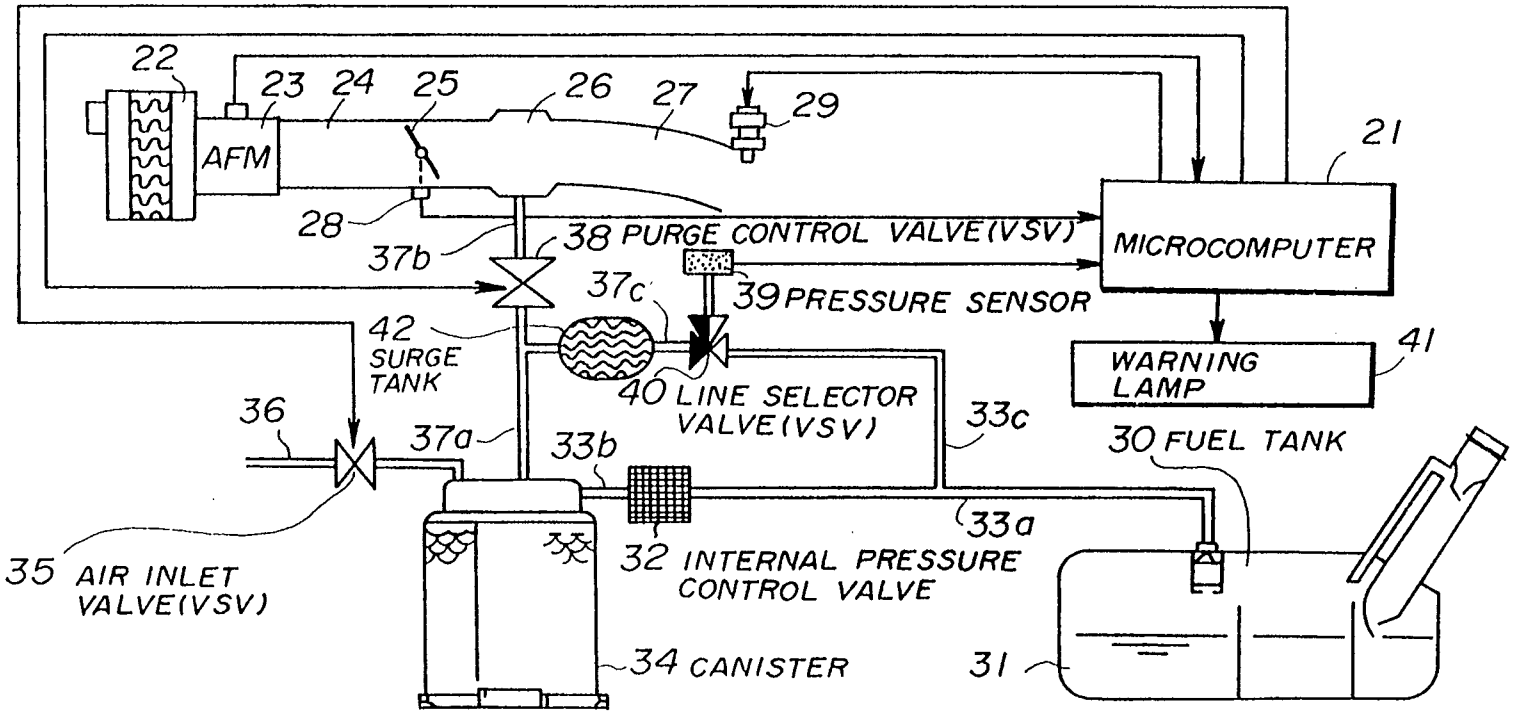
FIG. 13 is a diagram showing an evaporated fuel purge system to which the third embodiment of the present invention is applied.

FIG. 13 shows an evaporated fuel purge system to which the third embodiment of the present invention is applied. In FIG. 13, the parts which are the same as corresponding parts of the system in FIG. 5 are designated by the same reference numerals, and a description thereof will be omitted.

The evaporated fuel purge system in FIG. 13 is essentially the same as the system of FIG. 5, except that it has a surge tank 42 arranged in the purge line 37*c* between the line selector valve (VSV) 40 and the purge control valve (VSV) 38. This surge tank 42 corresponds to the capacity part 12 of the malfunction detecting apparatus of the third embodiment in FIG. 4. The functions of the negative pressure control part 8 and the discriminating part 13 of the apparatus in FIG. 4 are achieved by performing a malfunction detecting process on the evaporated fuel purge system in FIG. 13 by making use of the processing program in the microcomputer 21.

Figure 14:
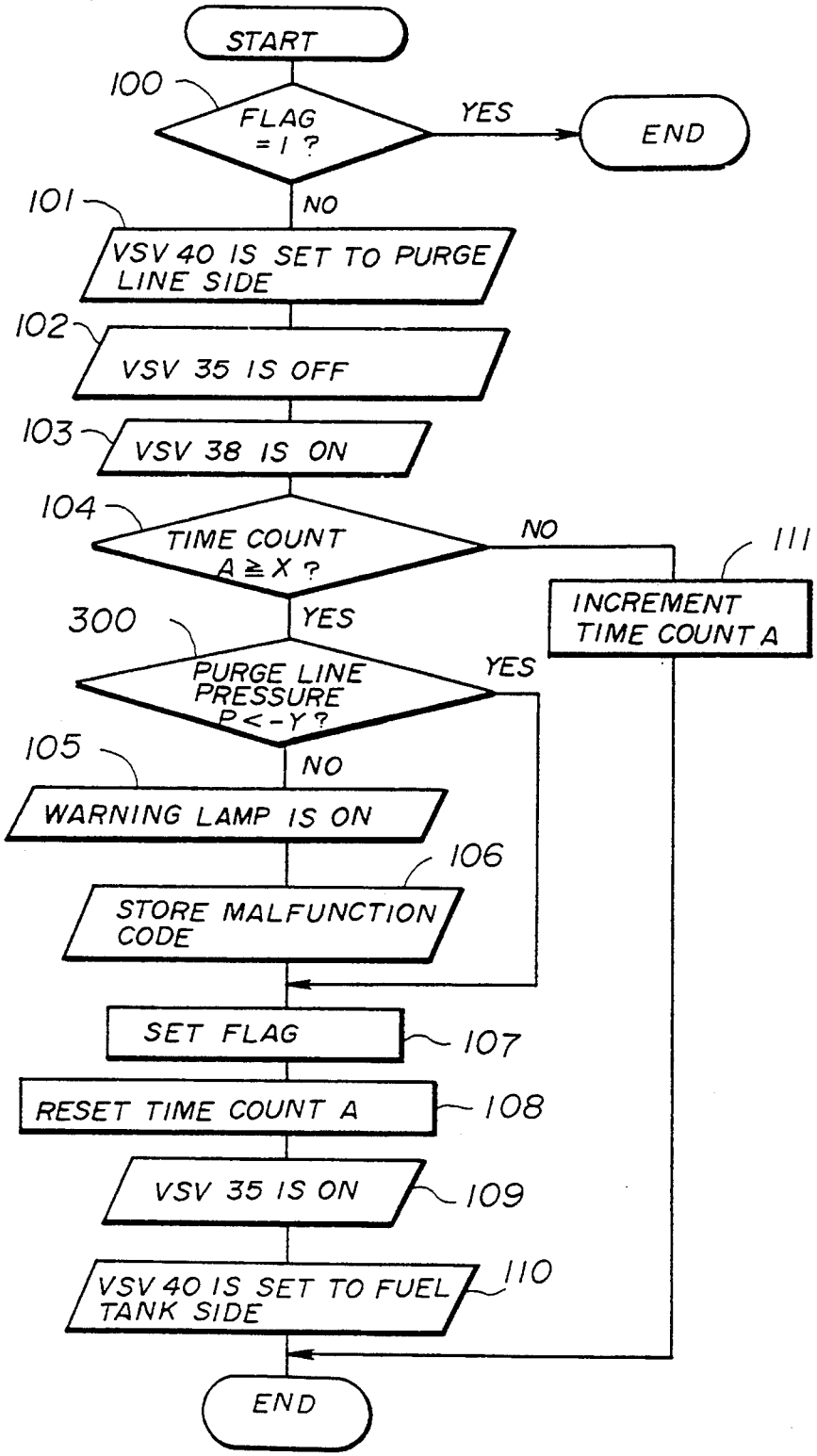
FIG. 14 is a flow chart for explaining a malfunction detecting process performed by the third embodiment of the present invention.

FIG. 14 shows a malfunction detecting process performed by the malfunction detecting apparatus of the third embodiment. In FIG. 14, the steps which are the same as corresponding steps of the first embodiment in FIG. 7 are designated by the same reference numerals, and a description thereof will be omitted. The malfunction detecting process in FIG. 14 is repeatedly run by an interrupt at time intervals of, for example, 65 ms. In the malfunction detecting process in FIG. 14, if the result at the step 104 is affirmative ($A \geqq X$), step 300 is performed, and, after the step 111 is performed, the steps 112–114 in FIG. 7 are not performed in the process in FIG. 14.

In the malfunction detecting process in FIG. 14, the CPU 50 of the microcomputer 21 at step 300 detects whether or not the measured purge line pressure (P), output from the pressure sensor 39, is lower than the reference pressure value ($-Y$). If the result at step 300 is affirmative ($P < -Y$), it is determined that the evaporated fuel purge system is normally operating, that is, that no malfunction has occurred. The steps 107–110, which are the same as corresponding steps in FIG. 7, are then performed, and the malfunction detecting process in FIG. 14 is finished. On the other hand, if the result at step 300 is negative ($P \geqq -Y$), it is determined that a malfunction in the evaporated fuel purge system has occurred. The steps 105–110, which are the same as corresponding steps in FIG. 7, are then performed, and the malfunction detecting process in FIG. 10 is finished.

Figure 15A:
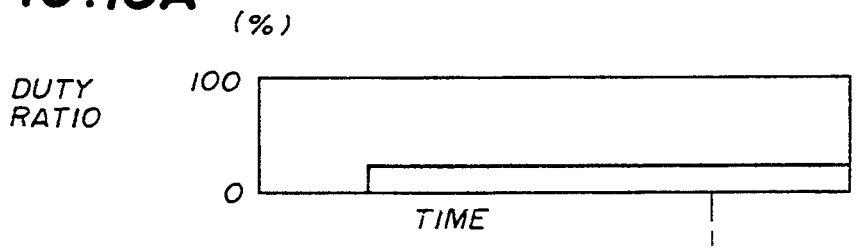
FIGS. 15A through 15C are time charts for explaining the operation of the malfunction detecting apparatus of the third embodiment.
Figure 15B:
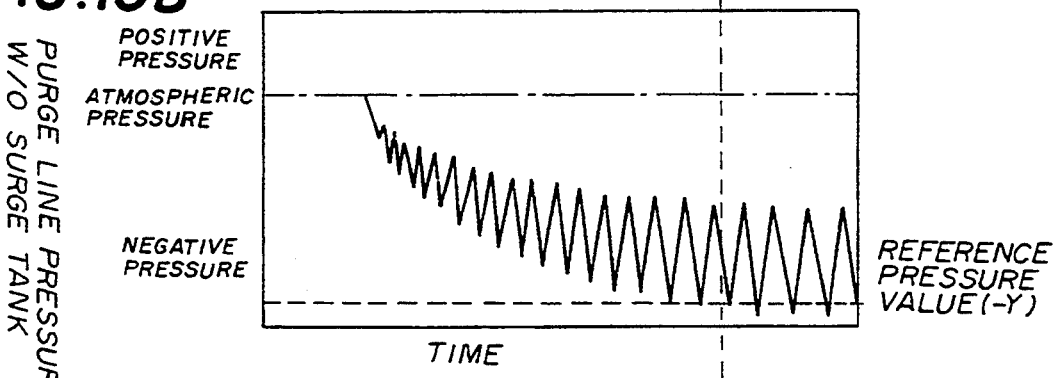
Figure 15C:
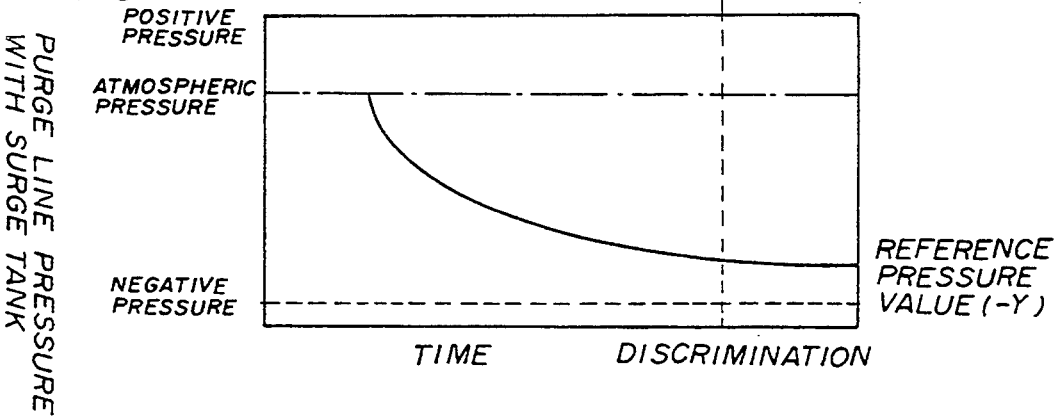

FIGS. 15A through 15C show the operation of the malfunction detecting apparatus of the third embodiment. In the evaporated fuel purge system in FIG. 13, the purge control valve (VSV) 38 is switched ON by a duty ratio control signal so as to have the canister 34 communicate with the intake passage via the purge lines, and this control signal indicates a relatively small duty ratio shown in FIG. 15A. At this time, the purge lines 37*a*–37*c* of the system are subjected to a negative pressure of the intake passage.

FIG. 15B shows the fluctuation of the purge line pressure at this time in an evaporated fuel purge system wherein no surge tank is arranged in the purge line between the pressure detecting part and the purge control valve. In contrast, FIG. 15C shows the change of the purge line pressure at this time in the evaporated fuel purge system of FIG. 13 wherein the surge tank 42 is arranged in the purge line 37*c* between the line selector valve (VSV) 40 and the purge control valve (VSV) 38. The fluctuation of the purge line pressure at the time of the negative pressure control is prevented by the surge tank 42, and the purge line pressure measured by the pressure sensor 39 is stabilized as indicated in FIG. 15C.

Thus, similarly to the first and second embodiments, the erroneous discrimination due to the fluctuation of the purge line pressure during the malfunction detecting process can be prevented. Further, as the malfunction detecting process in which the VSV 38 is switched ON by a control signal with a relatively small duty ratio is carried out, it is possible to prevent the exhaust emission performance of the engine from being deteriorated by the negative pressure control of the purge line of the system.

The evaporated fuel purge system to which the third embodiment of the present invention described above is applied is not limited to the system shown in FIG. 13. For example, it should be noted that a unit serving as both the canister and the surge tank can be provided in the system to which the malfunction detecting apparatus of the third embodiment is applied.

Figure 16:
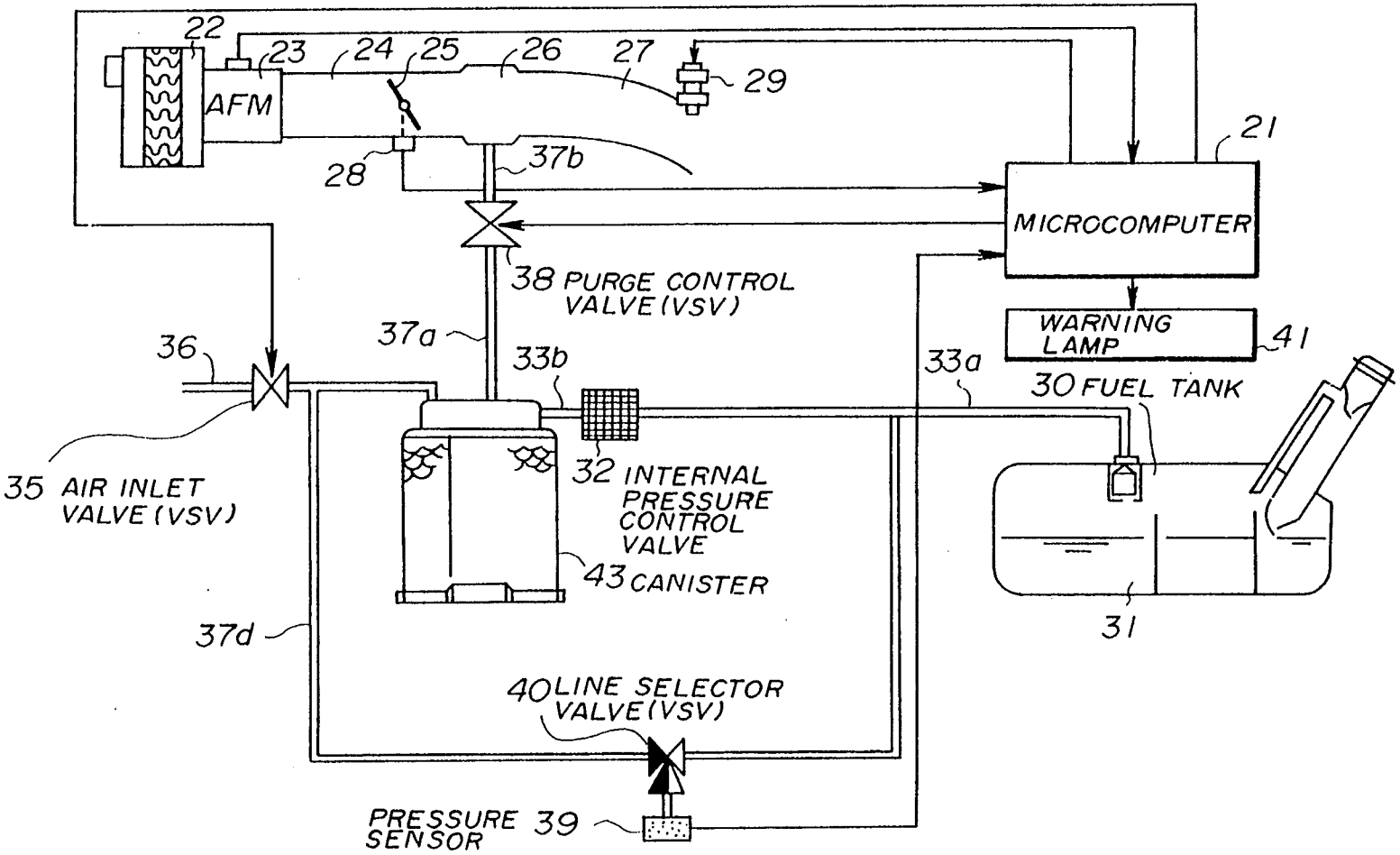
FIG. 16 is a diagram showing another evaporated fuel purge system to which the third embodiment is applied.

FIG. 16 shows such an evaporated fuel purge system to which the third embodiment of the present invention is applied. In the evaporated fuel purge system in FIG. 16, a canister 43 serving as both the canister and the surge tank is arranged instead of the surge tank 42 in FIG. 13. The vapor line 33*c* and the purge line 37*c* in FIG. 13 are respectively replaced by a vapor line 33*d* and a bypass line 37*d* in the evaporated fuel purge system in FIG. 16.

In the evaporated fuel purge system in FIG. 16, one end of the vapor line 33*d* is connected to an intermediate portion of the vapor line 33*a*, and the other end thereof is connected to the line selector valve (VSV) 40. One end of the bypass line 37*d* is connected to the air inlet line 36 between the canister 43 and the air inlet valve (VSV) 35, and the other end thereof is connected to the line selector valve 40. The vapor line 33*d* and the bypass line 37*d* pass around the canister 43, and the bypass line 37*d* communicates with the purge line 37*a* via the internal space of the canister 43. The pressure sensor 39 for sensing a purge line pressure is connected to the line selector valve 40.

In the evaporated fuel purge system in FIG. 16, the fluctuation of the purge line pressure at the time of the negative pressure control is prevented by the canister 43, and the purge line pressure at this time is measured by the pressure sensor 39. Thus, the measured pressure output from the pressure sensor 39 is stabilized as indicated in FIG. 15C. As an alternative to the evaporated fuel purge system in FIG. 16, the end of the bypass line 37*d* extending from the line selector valve 40 may be directly connected to the canister 43.

Further, the present invention is not limited to the above described embodiments, and variations and modifications may be made without departing from the scope of the present invention.

What is claimed is:

1. An apparatus for detecting a malfunction in an evaporated fuel purge system of an internal combustion engine, said system including a fuel tank for containing fuel, a canister for absorbing evaporated fuel, a vapor line through which evaporated fuel from the fuel tank is supplied to the canister, a purge line through which the evaporated fuel of the canister is supplied to an intake passage of the engine, and a purge control valve arranged in the purge line for controlling a flow of the evaporated fuel supplied from the canister to the intake passage through the purge line, said apparatus comprising:

negative pressure control means for switching on the purge control valve to open the purge line between the canister and the intake passage during a malfunction detecting process time, and for switching off the purge control valve at the end of the process time, so that the purge line and the vapor line are subjected to a negative pressure of the intake passage;

pressure detecting means, arranged in a pressure line connected to the purge line and to the vapor line, for measuring a purge line pressure within the system, and for outputting the measured pressure; and discriminating means for detecting whether or not a malfunction in the system has occurred, based on the measured purge line pressure supplied from the pressure detecting means, for calculating a continuous time during which the measured pressure is continuously lower than a reference pressure value within the process time, and for detecting whether or not the continuous time exceeds a reference time value within the process time.

2. An apparatus according to claim 1, wherein said discriminating means determines that no malfunction in the system has occurred if the continuous time is detected as not being smaller than the reference time value within the process time, and said discriminating means determines that a malfunction in the system has occurred if the continuous time is detected as being smaller than the reference time value within the process time.

3. An apparatus according to claim 1, wherein said negative pressure control means switches off an air inlet valve arranged in an air inlet line between the canister and the atmosphere at the start of the process time so as to close the air inlet line, and said negative pressure control means switches on the air inlet valve at the end of the process time so as to open the air inlet line.

4. An apparatus according to claim 1, wherein said discriminating means increments a detection time count when the measured pressure from the pressure detecting means is lower than the reference pressure value, and said discriminating means resets the detection time count to zero when the measured pressure is not lower than the reference pressure value.

5. An apparatus according to claim 1, wherein said pressure detecting means is connected to a line selector valve arranged in the pressure line, said pressure detecting means measuring a purge line pressure when the line selector valve is set to a first position so as to connect the pressure detecting means to the purge line via the line selector valve, and said pressure detecting means measuring a vapor line pressure when the line selector valve is set to a second position so as to connect the pressure detecting means to the vapor line via the line selector valve.

6. An apparatus for detecting a malfunction in an evaporated fuel purge system of an internal combustion engine, comprising:

negative pressure control means for switching on a purge control valve to open a purge line between a canister and an intake passage of the engine during a malfunction detecting process time, and for switching off the purge control valve at the end of the process time, so that the purge line and a vapor line are subjected to a negative pressure of the intake passage;

pressure detecting means, arranged in a pressure line connected to the purge line and to the vapor line, for measuring a purge line pressure within the system, and for outputting the measured pressure; and discriminating means for calculating a weighted average of the measured pressures supplied from said pressure detecting means, and for detecting whether or not a malfunction in the system has occurred, based on a value of the weighted average at the end of the process time.

7. An apparatus according to claim 6, wherein said discriminating means determines that a malfunction in the system has occurred if the value of the weighted average is detected as not being lower than a reference pressure value, and said discriminating means determines that no malfunction in the system has occurred if the value of the weighted average is detected as being lower than the reference pressure value.

8. An apparatus according to claim 6, wherein said discriminating means calculates a weighted average of the measured pressures supplied from the pressure detecting means based on a measured purge line pressure value and a previous weighted average value according to the formula: $PaSM=PaSM+dPa/n$, where dPa is the difference between the measured purge line pressure value Pa and a previous weighted average value PaSM, and n is a given coefficient.

9. An apparatus according to claim 6, wherein said negative pressure control means switches off an air inlet valve arranged in an air inlet line between the canister and the atmosphere at the start of the process time so as to close the air inlet line, and switches on the air inlet valve at the end of the process time so as to open the air inlet line.

10. An apparatus for detecting a malfunction in an evaporated fuel purge system of an internal combustion engine, said system including a fuel tank for containing fuel, a canister for absorbing evaporated fuel, a vapor line through which evaporated fuel from the fuel tank is supplied to the canister, a purge line through which the evaporated fuel of the canister is supplied to an intake passage of the engine, and a purge control valve arranged in the purge line for controlling a flow of the evaporated fuel supplied from the canister to the intake passage through the purge line, said apparatus comprising:

negative pressure control means for switching on the purge control valve to open the purge line between the canister and the intake passage during a malfunction detecting process time, and for switching off the purge control valve at the end of the process time, so that the purge line and the vapor line are subjected to a negative pressure of the intake passage;

pressure detecting means, arranged in a pressure line connected to the purge line and to the vapor line, for measuring a purge line pressure within the system, and for outputting the measured pressure;

capacity means, arranged in the pressure line between the pressure detecting means and the purge line, for preventing a fluctuation of the purge line pressure during the malfunction detecting process; and discriminating means for detecting whether or not a malfunction in the system has occurred, based on the measured pressure supplied from the pressure detecting means, and for detecting whether or not the measured pressure at the end of the process time is lower than a reference pressure value.

11. An apparatus according to claim 10, wherein said discriminating means determines that a malfunction in the system has occurred if said measured pressure is detected as not being lower than the reference pressure value, and determines that no malfunction in the system has occurred if said measured pressure is detected as being lower than the reference pressure value.

12. An apparatus according to claim 10, wherein said negative pressure control means switches off an air inlet valve arranged in an air inlet line between the canister and the atmosphere at the start of the process time so as to close the air inlet line, and switches on the air inlet valve at the end of the process time so as to open the air inlet line.

* * * * *